US006130028A

United States Patent [19]

McGuckin et al.

[11] Patent Number: 6,130,028

[45] Date of Patent: *Oct. 10, 2000

[54] PHOTOGRAPHIC STABILIZING PROCESSING SOLUTION AND METHOD OF USE

[75] Inventors: Hugh G. McGuckin, Rochester; John S. Badger, Webster; Brad M. Boersen, Rochester; Richard R. Horn, Fairport, all of N.Y.

[73] Assignee: Eastman Kodak Company, Rochester, N.Y.

[ * ] Notice: This patent is subject to a terminal disclaimer.

[21] Appl. No.: 09/286,899

[22] Filed: Apr. 6, 1999

Related U.S. Application Data

[62] Division of application No. 09/018,519, Feb. 4, 1998, Pat. No. 5,968,716.

[51] Int. Cl.[7] ..... G03C 7/30

[52] U.S. Cl. ..... 430/463

[58] Field of Search ..... 430/463

[56] References Cited

U.S. PATENT DOCUMENTS

| | | | |
|---|---|---|---|
| 3,676,136 | 7/1972 | Mowrey | 430/372 |
| 4,778,748 | 10/1988 | Kuse et al. | 430/428 |
| 4,786,583 | 11/1988 | Schwartz | 430/372 |
| 4,859,574 | 8/1989 | Gormel | 430/372 |
| 4,923,782 | 5/1990 | Schwartz | 430/372 |
| 5,110,716 | 5/1992 | Kuse et al. | 430/429 |
| 5,153,109 | 10/1992 | Abe et al. | 430/372 |
| 5,256,524 | 10/1993 | Yoshimoto et al. | 430/372 |
| 5,278,033 | 1/1994 | Hagiwara et al. | 430/429 |
| 5,360,700 | 11/1994 | Kawamura et al. | 430/428 |
| 5,362,609 | 11/1994 | Kuwae | 430/372 |
| 5,415,979 | 5/1995 | Takemura et al. | 430/372 |
| 5,424,177 | 6/1995 | Kobayashi et al. | 430/463 |
| 5,441,852 | 8/1995 | Hagiwara et al. | 430/372 |
| 5,529,890 | 6/1996 | McGuckin et al. | 430/429 |
| 5,578,432 | 11/1996 | McGuckin et al. | 430/429 |
| 5,716,765 | 2/1998 | McGuckin et al. | 430/372 |

FOREIGN PATENT DOCUMENTS

| | | |
|---|---|---|
| 0 504 609 B1 | 2/1992 | European Pat. Off. . |
| 0 506 349 A1 | 9/1992 | European Pat. Off. . |
| 0 519 190 A1 | 12/1992 | European Pat. Off. . |
| 0 521 477 A1 | 1/1993 | European Pat. Off. . |
| 0 529 794 A1 | 3/1993 | European Pat. Off. . |
| 0 530 832 A1 | 3/1993 | European Pat. Off. . |
| 0 551 757 A1 | 7/1993 | European Pat. Off. . |
| 289559 | 3/1993 | Japan . |

*Primary Examiner*—Hoa Van Le
*Attorney, Agent, or Firm*—J. Lanny Tucker

[57] ABSTRACT

Color photographic films are processed using a final dye image stabilizing solution containing certain aromatic or heterocyclic aldehydes, acetals or hemiacetals, and a mixture of specific surfactants. One surfactant is a nonionic polyethoxylated, nonfluorinated compound, or an anionic non-fluorinated sulfate or sulfonate, and the second surfactant is a nonionic or anionic fluorinated compound. This processing solution provides processed films, with or without a magnetic backing layer, that are free of scum or other residues, non-tacky, and resistant to abrasion and fingerprinting. The stabilizing solution can be provided in concentrated form, particularly when a glycol is included.

20 Claims, No Drawings

PHOTOGRAPHIC STABILIZING PROCESSING SOLUTION AND METHOD OF USE

CROSS-REFERENCE TO RELATED APPLICATIONS

This is a divisional of application Ser. No. 09/018,519 filed Feb. 4, 1998, now U.S. Pat. No. 5,968,716. Co-pending and commonly assigned U.S. Ser. No. 09/018,627, filed by McGuckin, Badger and Boersen on Feb. 4, 1998, now U.S. Pat. No. 5,952,158.

FIELD OF THE INVENTION

This invention relates in general to photography, and more particularly, it relates to a photographic stabilizing solution, and to a method of processing photographic silver halide films using that solution as the final processing solution.

BACKGROUND OF THE INVENTION

During the processing of photographic materials, one or more rinsing or washing steps may be used to remove residual processing solution from the materials prior to contact with the next processing solution. Moreover, before processed materials are dried, they are generally washed a last time to remove all remaining chemical residues so that when they are dried, they are free of lines, water spots or scum. For example, in processing most films and papers (both color and black and white), a final rinsing or stabilizing step is used prior to drying.

Many different formulations have been proposed for use as final rinse solutions in photographic processes immediately prior to drying. Generally, they include one or more surfactants that facilitate the "cleaning" of the photographic material and uniform liquid drainage. Some final processing solutions also contain dye image stabilizers and are thusly known as stabilizing solutions. In addition, rinse or stabilizing solutions can contain one or more biocides to prevent unwanted biological growth in the processing tank or on the photographic material. The solutions may additionally contain calcium ion sequestering agents or polymers such as polyvinylpyrrolidone to reduce precipitation of sulfur or sulfides.

To meet all of the needs of a final processing solution, a careful formulation of components, generally surfactants and biocides, must be made. Proper balancing is required to keep costs low, minimize foaming and biological growth, while achieving the desired drainage and defect free processing expected by highly critical customers.

For final processing solutions that are dye image stabilizing solutions, the presence of a dye image stabilizer further complicates the formulation needs. Dye image stabilizers typically have a methylene group (or is capable of producing a methylene group) that prevents redox degradation of certain magenta dye forming couplers. Thus, dye stain can be reduced or dye image enhanced with such solutions. Typical stabilizers include aldehydes, such as formaldehyde. Hexamethylenetetramine (HMTA) is a known substitute for formaldehyde because of its lower volatility. The addition of the stabilizer, and the type of stabilizer, can render some conventional surfactants in final rinse solutions ineffective in washing scum and other residue from the processed films.

Not every final processing solution (either final rinse or stabilizing solution) useful for processing one type of photographic element may be useful for processing other types of elements. Each type of photographic element may have surface characteristics, or be processed using unique chemicals that require unique final processing solution components.

For example, stabilizing solutions useful to process many conventional color negative films can contain an aldehyde) such as formaldehyde or a benzaldehyde) or hexamethylenetetramine (HMTA) and one or more surfactants, including a mixture of a nonionic surfactant and an anionic surfactant. Such processing solutions are described, for example, in U.S. Pat. No. 3,676,136 (Mowrey), U.S. Pat. No. 4,786,583 (Schwartz), U.S. Pat. No. 5,529,890 (McGuckin et al) and U.S. Pat. No. 5,578,432 (McGuckin et al) and EP-A-0 530 832 (Koma et al). In addition, recently allowed and commonly assigned U.S. Ser. No. 08/639,858 (filed Apr. 19, 1996, by McGuckin et al) now U.S. Pat. No. 5,716,765 describes the use of HMTA and mixtures of surfactants, including fluorinated nonionic surfactants, in final processing solutions for photographic films having a magnetic backing layer.

However, it has been observed that such stabilizing solutions are not always useful when processing a variety of commercial photographic films including those having a magnetic recording layer on one side of the polymeric film support. Thus, there is- a continuing need in the art for an improved, low cost, effective, formaldehyde-free and non-scumming photographic stabilizing solution that achieves all of the desired results when various films are processed in various processing machines.

SUMMARY OF THE INVENTION

The present invention provides an advance in the art of processing photographic films by providing a photographic dye image stabilizing solution comprising:

a) a compound represented by structure I present at a concentration of at least 0.5 g/l, b) a first surfactant that is: a nonionic polyethoxylated, non-fluorinated surfactant, or an anionic non-fluorinated sulfate or sulfonate surfactant, the first surfactant being present at a concentration of at least 0.03 g/l, and c) a second surfactant that is a nonionic or anionic fluorinated surfactant present at a concentration of at least 0.005 g/l, structure I being

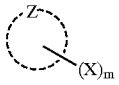

wherein Z represents the carbon, nitrogen, sulfur or oxygen atoms necessary to form a 5- to 10-membered carbocyclic or heterocyclic ring, X is an aldehyde group or $(R_1O)(R_2O)CH$- group, $R_1$ and $R_2$ are independently hydrogen or an alkyl group of 1 to 6 carbon atoms, provided that at least one of $R_1$ and $R_2$ is an alkyl group, and m is 1 to 4.

This invention also provides a concentrated photographic dye image stabilizing solution comprising:

a) a compound represented by structure I above present at a concentration of from about 15 to about 300 g/l, b) the first surfactant described above that is present at a concentration of from about 0.9 to about 600 g/l, c) the second surfactant described above that is present at a concentration of from about 0.15 to about 300 g/l, and d) a water-soluble or water-dispersible glycol that is present at a concentration of from about 15 to about 1000 g/l.

Further, this invention provides a method for photographic processing comprising:

treating an imagewise exposed and color developed silver halide photographic film comprising a polymeric support and having disposed on one side thereof, a silver halide emulsion layer, with the dye image stabilizing solution described above.

Still again, this invention provides a processing method whereby the photographic film is treated with a stabilizing solution that is prepared by diluting the concentrated stabilizing solution noted above from 30 to 120 times.

The processing method of this invention represents an improvement in the art because the specific final dye image stabilizing solution of this invention reduces the amount of scum defects on the base-side (non-emulsion side) of processed photographic films. This advantage is particularly evident when the films are processed in various processors, including what are known as "rack and tank" processors (no squeegees present), or what are known as "rapid access" minilab processors (low volumes and shortened process times).

The films, particularly those having a magnetic backing layer, processed using this invention show reduced residue (scum) and are non-tacky, and resistant to abrasion and fingerprinting. Moreover, the stabilizing solutions used in the method can be formulated, packaged and stored in a single concentrated solution when a glycol is included. While not intending to be limited to a specific explanation, it is believed that the glycol solubilizes the other components in the concentrated solution.

This improvement is achieved with a specific combination of first and second surfactants. The first surfactant can be chosen from two different classes of compounds: nonionic polyethoxylated non-fluorinated surfactants, and anionic, non-fluorinated sulfates or sulfonate surfactants. The second surfactant is a nonionic or anionic fluorinated surfactant. The first and second surfactants are combined with one or more specific formaldehyde-free (non-formaldehyde releasing) compounds represented by Structure I. The use of these compounds in combination avoids the release of formaldehyde which is a known health hazard and cleanly processes the films. In the concentrated solutions of the invention, the presence of the glycol is also critical.

DETAILED DESCRIPTION OF THE INVENTION

The stabilizing solutions (working strength) of this invention are aqueous solutions generally having a pH of from about 4 to about 10. Preferably, the pH is from about 5 to about 9, and more preferably, it is from about 6.5 to about 8.5. The pH of the concentrated solution of this invention may vary somewhat from that of the working strength solution, and generally it is lower than the pH of the working strength solution (typically from about 3 to about 10).

The final processing solution can be packaged and transported as a working strength solution, or as a single concentrated composition. It can be used as a replenisher as well as the initial tank working solution. When formulated into concentrated form, the solution can be diluted up to 120 times (preferably 30 to 120 times and more preferably from 50 to 70 times) with water or a buffer solution to provide a suitable working strength solution, depending upon the concentrations and solubilities of the various components.

The first essential surfactant in the stabilizing solution is chosen from one or more of the following three classes of compounds.

The first type of compounds includes water-soluble nonionic polyethoxylated non-fluorinated surfactants, or a mixture of such materials. "Nonionic surfactants" refer to surfactants that are not ionized in an aqueous medium. Particularly useful nonionic polyethoxylated non-fluorinated surfactants include, but are not limited to, polyhydric alcohols and hydrocarbon polyethoxylated surfactants having the general formula (I):

$$R—(B)_x—(E)_m—D$$

wherein R is a substituted or unsubstituted alkyl group having 8 to 20 carbon atoms, B is a substituted or unsubstituted phenylene group, x is 0 or 1, E is $—(OCH_2CH_2)—$, m is an integer of 6 to 20, and D is hydroxy or methoxy.

Examples of useful nonionic non-fluorinated surfactants include, but are not limited to, octylphenoxypoly(ethyleneoxide)(9) ethanol (available from Union Carbide Co. under the tradename TRITON X-100), octylphenoxypolyethyleneoxide(12) ethanol (available from Union Carbide Co. under the tradename TRITON X-102), octylphenoxypolyethyleneoxide(30-40) ethanol (available from Union Carbide Co. under the tradename TRITON X-405), alkyl($C_{12}$–$C_{15}$ mixture) polyethyleneoxide(7) alcohol (available from Shell Chemical Co. under the tradename NEODOL 25-7), tridecylpolyethyleneoxide(12) alcohol (available from ICI Americas, Inc., under the tradename RENEX 30), poly(ethylene oxide)-poly(propylene oxide), and poly (ethylene oxide) di-ol (available from-BASF Corp., under the tradename PLURONIC L-44), and nonylphenoxy poly[hydroxy propylene oxide(8-10)] (available from Olin Corp. under the tradename SURFACTANT 10G).

Preferred nonionic surfactants of this type include the TRITON brand surfactants and the NEODOL 25-7 surfactant.

Other useful materials of this type are well known in the patent and trade literature, and would therefore be readily apparent to one skilled in the art.

A second class of compounds useful as the first surfactant includes anionic non-fluorinated sulfate or sulfonates. "Anionic" means that the compounds have a net negative charge. Such compounds can be represented by the following formulae:

$$R_3—(A)—C$$

or $$(R_4)_p—(B)_y—(E)_z—C$$

wherein $R_3$ is a substituted or unsubstituted alkyl group of 8 to 20 carbon atoms (preferably 10-16 carbon atoms), A is a substituted or unsubstituted arylene or hydroxyethylene group, C is $—SO_3^-M^+$ or $—SO_4^-M^+$ wherein $M^+$ is hydrogen, or ammonium or an alkali metal ion (such as lithium, sodium or potassium), $R_4$ is a substituted or unsubstituted alkyl group of 4 to 20 carbon atoms (preferably 4 to 16 carbon atoms), y is 0 or 1, p is 1 when y is 0, and p is 1, 2 or 3 when y is 1, B is a substituted or unsubstituted phenylene group, E is $—(OCH_2CH_2)—$, and z is an integer from 1 to 8.

Such first surfactants include, but are not limited to, alkylbenzenesulfonates, 2-hydroxytetra, alkane-1-sulfonates, alkylphenoxypolyethoxysulfates, and alkylpolyethoxysulfates. Representative compounds include sodium dodecylsulfonate (available from Rhone-Poulenc as SIPONATE DS-10), sodium 2-hydroxytetra, hexadecane-1-sulfonate (available from Witco as WITCONATE AOS), sodium nonylphenoxypolyethoxy sulfate (available from Witco as WITCOLATE DS-10), sodium tributyl phenoxypolyethoxysulfate (available from Hoechst Celanese as HOSTAPAL BV), sodium alkyl($C_9$–$C_{12}$)polyethyleneoxide (7)ethanesulfonate (available from PPG as AVANEL S-70), and sodium ($C_{12-C15}$)polyethoxy(3)sulfate (available from Witco as WITCOLATE ES-3). Various useful anionic surfactants are also described in U.S. Pat. No. 5,360,700 (Kawamura et al).

The first surfactants used in the stabilizing solution of this invention can include a mixture of any of either or both of the two classes described above.

The second surfactant in the stabilizing solution of this invention is a nonionic or anionic fluorinated surfactant or a mixture of each or both of such compounds.

Nonionic fluorinated surfactants are also known in the art. Typically, such compounds are water-soluble or water-dispersible and have one or more fluorocarbon moieties in the molecule wherein at least one hydrogen atom has been replaced with a fluorine atom. Each fluorocarbon moiety generally has at least 4 carbon atoms and can be saturated or unsaturated.

A representative class of nonionic fluorinated surfactants has the formula:

$$R_f—CH_2CH_2O—(CH_2CH_2O)_z—H$$

wherein $R_f$ is $$F—(CF_2CF_2)_{3-8}—$$

and z is 4 to 20.

Representative surfactants of this type include, but are not limited to, fluoroalkylpolyethyleneoxide alcohols, such as those commercially available as ZONYL FSN, ZONYL FS 300 or ZONYL FSO from DuPont Co., or as FLUORAD FC-430 or FLUOWET OT from American Hoechst. ZONYL FSO nonionic surfactant is most preferred of this type of material.

A class of anionic fluorinated surfactants can be represented by the structure:

$$R_f—Y$$

wherein $R_f$ is defined above and is preferably mostly $C_6F_{13}^-$, $C_8F_{17}^-$ and $C_{10}F_{31}^-$ groups. Y is $—SO^-{}_3M^+$, $—SO^-{}_4M^+$ or $—CO_2{}^{31}$ $M^+$ wherein $M^+$ is defined above.

These anionic fluorinated surfactants can be generally described as fluoroalkylsulfonates, fluoroalkylsulfates and fluoroalkylcarboxylates. The potassium or sodium fluoroalkylsulfonates and -sulfates are preferred.

Representative surfactants of this type include, but are not limited to, MEGAFAC F116 (sodium perfluorooctane sulfonate), FLUORAD FC-95, FLUORAD FC-120 and FLUORAD FC-143 (all available from 3M Co.)

Other examples of all types of first and second surfactants that are available commercially are described by tradename and commercial source in *McCutcheon's Volume* 1: *Emulsifiers & Detergents,* 1993 North American Edition, McCutcheon Division, MC Publishing Co., Glen Rock, N.J.

The concentration of the one or more first surfactants in the working strength stabilizing solution is generally at least 0.03 g/l, and preferably at least 0.05 g/l, and generally less than 5, and preferably less than 0.5 g/l. The concentration of the one or more second surfactants is generally at least 0.005 g/l, preferably at least 0.01 g/l, and generally less than 3 g/l, and preferably less than 0.1 g/l.

The weight ratio of the two types of surfactants in the solution can vary widely, but preferably, the weight ratio is from about 1000:1 to about 1:1000 (first surfactant to second surfactant). More preferably, the weight ratio is from about 20:1 to about 1:20, and a weight ratio of from about 10:1 to about 1:1 is most preferred. The ZONYL brand nonionic fluorinated surfactants generally can be used at lower concentrations.

As noted above, the stabilizing solution contains one or more dye image stabilizing compounds that are carbocyclic aromatic or heterocyclic compounds having at least one aldehyde, acetal or hemiacetal group on the aromatic or heterocyclic ring. More particularly, these compounds can be represented by the structure I

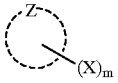

wherein Z represents the carbon, nitrogen, sulfur and oxygen atoms necessary to provide a 5- to 10-membered, substituted or unsubstituted, carbocyclic or heterocyclic ring (including aromatic and condensed rings), including but not limited to, phenyl, thiophene, pyrrole, furan, thiazole, imidazole, pyrazole, succinimide, triazole, tetrazole, pyridine, pyrimidine, triazine, thiadiazine, naphthalene, benzofuran, indole, thionaphthalene, benzimidazole, benzotriazole and quinoline rings. The five- and six-membered rings in this list are preferred, and phenyl is most preferred.

In Structure I, X is an aldehyde group, or a $(R_1O)(R_2O)CH—$ group. Preferably, X is an aldehyde group. Moreover, m is an integer of 1 to 4. Preferably, m is 1 or 2, and most preferably, it is 1.

$R_1$ and $R_2$ are independently hydrogen or a substituted or unsubstituted alkyl group of 1 to 6 carbon atoms (preferably 1 to 3 carbon atoms), provided that at least one of $R_1$ and $R_2$ is an alkyl group. Preferably, $R_1$ and $R_2$ are independently hydrogen, substituted or unsubstituted methyl or substituted or unsubstituted ethyl, provided that only one of them is hydrogen. Most preferably, one is hydrogen and the other is substituted or unsubstituted methyl, or both are methyl.

The ring structure can be further substituted with any of the following substituents other than X as desired, or the $R_1$ and $R_2$ groups can have one or more substituents selected from the following group of monovalent radicals: hydroxy, an alkyl group (having 1 to 7 carbon atoms, such as methyl, methoxymethyl, hydroxymethyl, ethyl, benzyl, carboxymethyl, sulfopropyl and a halomethyl), an aralkyl group (having 7 to 10 carbon atoms, such as 4-methylphenyl, 3-carboxymethylphenyl and 2-chloro-4-ethylphenyl), an alkoxy group (having 1 to 6 carbon atom, such as methoxy, ethoxy, isopropoxy, t-butoxy, 2-hydroxyethoxy and methoxyethoxy), aroxy (such as phenoxy), a halogen, a nitro group, a sulfo group, a carboxy group, an amino group (primary, secondary and tertiary, such as N,N-dimethylamino, N-ethylamino, N-phenylamino and N-methyl-N-ethylamino), an aryl group (having 6 to 10 carbon atoms, such as phenyl, naphthyl, p-methoxyphenyl, 3-carboxyphenyl and p-chlorophenyl), a cyano group, an acyloxy group, an acylamino group, a sulfonamide group, a sulfamoyl group (such as N-ethylsulfamoyl and N,N-dimethylsulfamoyl), a carbamoyl group (such as carbamoyl, N-methylcarbamoyl, N,N-tetramethylenecarbamoyl) or a sulfonyl group (such as methanesulfonyl, ethanesulfonyl, benzenesulfonyl and p-toluenesulfonyl).

Preferably, the compound of structure I has one or two aldehyde groups (m is 1 or 2), and more preferably only 1 aldehyde group, in combination with one or two of the substituents noted above. Particularly, there is one or more hydroxy groups, and most preferably, there is a single hydroxy group.

Representative compounds of structure I are described in more detail in EP-A-0 530 832 (Koma et al), as Compounds F-1 to F-77, which publication is incorporated herein by reference. Of these compounds, the following are preferred, and m- or p-hydroxybenzaldehyde, or a mixture thereof, is more preferred, and m-hydroxybenzaldehyde is most preferred:

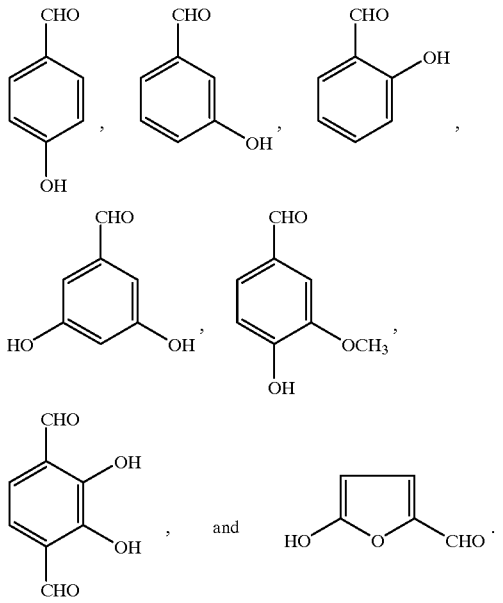

The one or more compounds of structure I are present at a concentration of generally at least 0.5 g/l, and preferably at least 1 g/l, and generally less than 5 g/l and preferably less than 3 g/l.

While not necessary, other addenda can be included in the stabilizing solution if desired, including but not limited to, conventional biocides (such as isothiazolones, halogenated phenolic compounds disulfide compounds and sulfamine agents), water-soluble polymers [such as poly(vinyl pyrrolidones)], water-soluble metal chelating agents (such as hydrolyzed polymaleic anhydride polymers, inorganic and organic phosphoric acids and aminopolycarboxylic acids), defoaming agents, a source of cupric ion (such as cupric nitrate) for some biocides, a source of ammonium ion (such as from common ammonium salts), a source of sulfite ion (such as from a common organic or inorganic sulfite), buffers and other materials readily apparent to one skilled in the photographic art. These optional materials can be present in conventional amounts (e.g. as described in the art cited above, including EP-A-0 530 832).

It is preferred that the stabilizing solution contain a biocide such as an isothiazolone or mixtures of isothiazolones, for example the commercially available KATHON LX biocide, in conventional amounts. A poly (vinyl pyrrolidone) can also be present, if desired, in a conventional amount.

It is preferred that the solution also contain one or more low molecular weight, water-soluble or water-dispersible glycols, that is glycols having a molecular weight below 400. Such compounds include, but are not limited to, ethylene glycol, propylene glycol, diethylene glycol, triethylene glycol, tetraethylene glycol and mixtures thereof. Diethylene glycol and propylene glycol are preferred with diethylene glycol being most preferred. The glycol is generally present at a concentration of at least 0.5 g/l, and preferably at least 3 g/l, and generally less than 20 g/l, and preferably less than 15 g/l, in the working strength solution. Alternatively, the amount of glycol is determined from the concentration of the compound of Structure I. Generally, the weight ratio of glycol to that compound is from about 1:1 to about 30:1. More preferably, the ratio is from about 2.5:1 to about 10:1.

The components of the stabilizing solution described herein can be mixed together in any suitable order as would be known in the art, and stored indefinitely or used immediately.

The solution can also be formulated in a concentrated form for storage and transportation, then diluted from 30 to 120 times with water or a suitable buffer prior to or during use, depending upon the concentrations and solubilities of the various components. Preferably, the dilution rate is from about 50 to about 70 times to provide a desired working strength solution.

Thus, a concentrated stabilizing solution of this invention can comprise four essential components:

- one or more of the compounds represented by structure I present at a concentration of from about 15 to about 300 g/l,
- one or more of the first surfactants present at a concentration of from about 0.9 to about 600 g/l,
- one or more of the second surfactants present at a concentration of from about 0.15 to about 300 g/l, and
- one or more of the water-soluble or water-dispersible glycols present at a concentration of from about 15 to about 1000 g/l.

More preferably, the concentrated solution components are- present as follows:

- one or more of the compounds represented by structure I present at a concentration of from about 30 to about 250 g/l,
- one or more of the first surfactants present at a concentration of from about 1.5 to about 160 g/l,
- one or more of the second surfactants present at a concentration of from about 0.3 to about 12 g/l, and
- one or more of the glycols present at a concentration of from about 90 to about 1000 g/l.

Most preferably, the concentrated solution components are present as follows:

- one or more of the compounds represented by structure I present at a concentration of from about 50 to about 210 g/l,
- one or more of the first surfactants present at a concentration of from about 5 to about 35 g/l,
- one or more of the second surfactants present at a concentration of from about 0.5 to about 7 g/l, and
- one or more of the glycols present at a concentration of from about 150 to about 900 g/l.

The stabilizing solution of this invention is used in the final processing step, after color development, bleaching, and fixing, and prior to drying. Preferably, one or more water washing steps precede the stabilizing step.

The present invention can therefore be used to process silver halide color negative (PROCESS C-41) or color reversal (PROCESS E-6) films, with or without a magnetic backing layer or stripe. Preferably, color negative films having a magnetic backing layer are processed using this invention.

During such processing, conventional procedures can be used for replenishment of the various processing solutions, including the stabilizing solution. Preferably, replenishment of the stabilizing solution is not more than 700 ml/m$^2$, and preferably from about 100 to about 600 ml/m$^2$ of processed photographic film. The processing equipment can be any suitable processor having one or more processing tanks or vessels, including mini-lab processors and other larger scale processors. The stabilizing step can be carried out in one or more tanks arranged in countercurrent flow, if desired.

The stabilizing step can be carried out at a temperature of from about 20 to about 60° C., and for generally at least 20, and preferably at least 40 seconds, and generally less than 200, and preferably less than 60 seconds. Optimal processing conditions are at from about 27 to about 38° C. for from about 20 to about 200 seconds.

The emulsions and other components, and element structure of such photographic materials and the various steps used to process them are well known and described in considerable publications, including, for example, *Research Disclosure*, publication 38957, pages 592–639 (September 1996) and hundreds of references noted therein. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below. The invention can be practiced with photographic films containing any of many varied types of silver halide crystal morphology, sensitizers, color couplers, and addenda known in the art, as described in the noted *Research Disclosure* publication and the many publications noted therein. The films can have one or more layers, at least one of which is a silver halide emulsion layer that is sensitive to electromagnetic radiation, disposed on a suitable film support (typically a polymeric material). Preferred films processed according to this invention are color negative films.

The processed film elements preferably have a magnetic recording layer, or stripe, on the support opposite the silver halide emulsion layer(s).

Formulations for preparing magnetic recording layers are also well known in the art, as described for example, in *Research Disclosure*, publication 34390, November, 1992, U.S. Pat. No. 5,395,743 (Brick et al), U.S. Pat No. 5,397,826 (Wexler), and Japanese Kokai 6-289559 (published Oct. 18, 1994), all incorporated herein by reference. The magnetic recording layers generally include a dispersion of ferromagnetic particles in a suitable binder. Preferably, the binder is transparent so the layer is transparent, but this is not essential. As might be expected, it is highly desirable that the magnetic recording layer not only exhibit desired magnetic and photographic performance, but that it also be highly durable, abrasion resistant and scratch resistant.

Suitable ferromagnetic particles would be readily apparent to one skilled in the art. They include, but are not limited to, ferromagnetic iron oxides (such as g—$Fe_2O_3$ or $Fe_3O_4$) with or without cobalt, zinc or other metal dopants in solid solution or surface treated, ferromagnetic chromium dioxides with or without metallic elements or halogen atoms in solid solution, ferromagnetic chromium dioxide powders, barium ferrite and others known in the art. Ferromagnetic metal pigments with an oxide coating on their surface to improve their chemical stability or to improve dispersibility as is commonly employed in conventional magnetic recording, may also be used if desired. In addition, magnetic oxides with a thicker layer of lower refractive index oxide or other material having a lower optical scattering cross-section can be used. Cobalt doped-iron oxide is the preferred ferromagnetic material useful in the practice of this invention.

The magnetic recording layer typically contains one or more transparent binders, dispersant-cobinders, optional non-magnetic particulate materials, grind solvents, coating aids, surfactants, crosslinking agents, catalysts, and other conventional addenda for such layers. The amounts and proportions of the various components of such layers are also known in the art (see publications noted above).

While the magnetic recording layer can cover only a portion of the surface of the support, generally it covers nearly the entire surface, and can be applied using conventional procedures including coating, printing, bonding or laminating.

Various supports can be used for the films processing according to this invention including the conventional acetates, cellulose esters, polyamides, polyesters, polystyrenes and others known in the art. Polyesters such as poly(ethylene terephthalate), poly(ethylene naphthalate), poly-1,4-cyclohexanedimethylene terephthalate, polyethylene 1,2-diphenoxyethane-4,4'-dicarboxylate and polybutylene terephthalate are preferred. These materials can be subbed or unsubbed and coated with various antihalation, antistatic or other non-imaging layers as is known in the art. Particularly useful antistatic layers on the backside of the elements include vanadium pentoxide in a suitable binder.

Because the elements having a magnetic recording layer are transported in cameras and across magnetic heads, they generally have a lubricant, such as a fatty acid ester (for example, butyl stearate), applied to the magnetic recording layer to facilitate element transport. The lubricant can be in the form of a uniform coating, or present in a regular or irregular pattern. The lubricant can be a single material or a mixture of two or more materials as long as the eventual coating provides a coefficient of friction of less than about 0.5. Coefficient of friction is determined using a conventional paper clip friction test described, for example, in ANSI IT 9.4-1992. Various lubricants can be used such as silicone oils or waxes, fluorine-containing alcohols, esters or ethers, fluorinated polyalkanes, polyolefins, polyglycol alkyl phosphates or alkali metal salts thereof, polyphenyl ethers, fluorine-containing alkylsulfates or alkali metal salts thereof, monobasic fatty acids or metal salts thereof, mono- or polyvalent alcohols, alkoxy alcohols, fatty acid esters or monoalkyl ethers or alkylene oxide polymers, fatty acid amides and aliphatic amines. A preferred lubricant is commercially available carnauba wax.

Reagents and solutions for black-and-white and color development are well known, and described, for example, in *Research Disclosure* (noted above), sections XVIII and XIX, and the many references described therein. Thus, besides a developing agent (either black-and-white or color developing agent), the developers can include one or more buffers, antioxidants (or preservatives), antifoggants, solubilizing agents, brighteners, halides, sequestering agents and other conventional addenda.

Bleaching and fixing solutions and reagents are also well known, as described for example, in *Research Disclosure* (noted above), section XX and the many references noted therein. Common bleaching agents include, but are not limited to, ferric salts or ferric binary or ternary complexes of aminopolycarboxylic acids of many various structures. Fixing agents include, but are not limited to, thiosulfates. Various bleaching and fixing accelerators are also known.

Processing steps and solutions specific to processing color negative films (Process C-41) and color reversal films (Process E-6) are known in the art.

Processing according to the present invention can be carried out using conventional deep tanks holding processing solutions. Alternatively, it can be carried out using what is known in the art as "low volume thin tank" processing systems using either rack and tank, roller transport or automatic tray designs. Such processing methods and equipment are described, for example, in U.S. Pat. No. 5,436,118 (Carli et al) and publications cited therein.

The following examples are included for illustrative purposes only. Unless otherwise indicated, the percentages are by weight.

MATERIALS AND METHODS FOR EXAMPLES

In the following Examples 1–5, the film samples (three replicates of each film in each solution) were processed using the following protocol:

| | | |
|---|---|---|
| Color development | 195 sec. | 37–38° C. |
| Bleaching | 390 sec. | 35–41° C. |
| Washing | 195 sec. | 24–41° C. |
| 1st fixing | 195 sec. | 35–41° C. |
| 2nd fixing | 195 sec. | 35–41° C. |
| Washing | 195 sec. | 24–41° C. |
| Stabilizing | 195 sec. | 24–41° C. |
| Drying | ~26 minutes | 37–38° C. |

The recommended commercially available Kodak PROCESS C-41 solutions (KODAK FLEXICOLOR Developer, KODAK FLEXICOLOR Bleach III, and KODAK FLEXICOLOR Fixer and Replenisher) for color development, bleaching and fixing were used in all examples utilizing a commercially available Refrema rack and tank processor (Model C-41-90-GL-V-ESS).

A conventional acetate base 135 format color photographic film having no magnetic backing layer was used in the following examples (commercially available KODAK GOLD 200 Film, 5282, identified as Film A). A conventional magnetic backed color negative photographic film was also used in the examples (KODAK ADVANTIX 100 Film, 5194, identified as Film B) the components of which are described in considerable detail in U.S. Pat. No. 5,395,743 (Brick et al) and U.S. Pat. No. 5,397,826 (Wexler) and *Research Disclosure*, publication 34390, November 1992. All film samples were uniformly exposed (fogged) under room light.

The processed film samples were examined for residue after the stabilizing step by viewing the base-side under a halogen specular light source (Sunnex Model 703-27 with a 20 watt halogen lamp and frosted lens) positioned about 15 cm from the film sample. The amount of observed residue was rated on a scale of "1" to "4" using the following criteria:

| RATING VALUE | MEANING |
|---|---|
| 1 | No observable residue under specular light, or normal room lighting |
| 2 | Residue easily observed under specular light, but not normal room lighting |
| 3 | Residue observed under both normal room lighting and specular light |
| 4 | A very heavy residue deposit easily observed under both room lighting and specular light |

Film samples that did not fit exactly into the above ratings were given intermediate (½) ratings between the two most appropriate numbers.

Stabilizer Formulations

The following stabilizing solutions (A-W) were used in the various Examples:

A: Commercially available KODAK FLEXICOLOR® Stabilizer and Replenisher LF containing hexamethylenetetraamine (4.0 g/l), diethanolamine (0.65 g/l) IRGAFORM 3000 (0.5 g/l) sequestrant, PROXEL® GXL biocide (0.06 g/l), poly(vinyl pyrrolidone) (0.25 g/l), TRITON® X-102 nonionic surfactant (0.2 g/l), WITCOLATE® ES-3 anionic surfactant (0.2 g/l). pH=7.9

B: Commercially available KONICA FORMALDEHYDEFREE® Color Negative Film Super Stabilizer II. pH=8.5

C: m-Hydroxybenzaldehyde (1.5 g/l), MEGAFAC® F116 surfactant (0.05 g/l), PROXEL® GXL biocide (0.06 g/l). pH=7.6

D: m-Hydroxybenzaldehyde (1.5 g/l), ZONYL® FSO nonionic fluorinated surfactant (0.025 g/l), NEODOL® 25-7 nonionic surfactant (0.2 g/l), PROXEL® GXL biocide (0.06 g/l). pH=7.2

E: m-Hydroxybenzaldehyde (1.5 g/l), ZONYL® FSO nonionic fluorinated surfactant (0.025 g/l), NEODOL® 25-7 nonionic surfactant (0.2 g/l), KATHON® LX biocide (0.02 g/l), copper nitrate (0.003 g/l). pH=7.2

F: Same as solution E with the addition of propylene glycol (13.5 g/l). pH=7.2

G: Same as solution E with the addition of diethylene glycol (13.5 g/l). pH=7.1

H: m-Hydroxybenzaldehyde (1.5 g/l), ZONYL® FSO nonionic fluorinated surfactant (0.025 g/l), NEODOL® 25-7 nonionic surfactant (0.2 g/l), KATHON® LX biocide (0.03 g/l), copper nitrate (0.003 g/1). pH=7.2

I: Same as solution H with the addition of propylene glycol (13.5 g/l). pH=7.2

J: Same as solution H with the addition of diethylene glycol (13.5 g/l). pH=7.1

K: Same as solution I with the addition of poly(vinyl pyrrolidone) (0.25 g/l). pH=7.2

L: Same as solution J with the addition of poly(vinyl pyrrolidone) (0.25 g/1). pH=7.1

M: Same as solution C with the addition of diethylene glycol (13.5 g/l). pH=7.5

N: Same as solution I but with WITCOLATE® ES-3 anionic surfactant (0.2 g/l) and TRITON® X-102 nonionic surfactant (0.2 g/l) in place of ZONYL® FSO nonionic surfactant and NEODOL® 25-7 nonionic surfactant. pH=7.2

O: Same as solution G but replacing NEODOL 25-7 nonionic surfactant with SIPONATE DS 10 anionic surfactant (0.2 g/l). pH=6.9

P: Same as solution G but replacing m-hydroxybenzaldehyde with p-hydroxybenzaldehyde (1.5 g/l). pH=6.8

Q: Same as solution G but replacing ZONYL FSO nonionic surfactant with MEGAFAC F116 anionic surfactant (0.05 gl/l). pH=7.2

R: Same as solution G but replacing diethylene glycol with ethylene glycol (13.5 g/l). pH=7.2

S: Same as solution G but replacing diethylene glycol with Carbowax 350 (13.5 g/1). pH=6.9

T: Same as solution G but with diethylene glycol at 6.75 g/l. pH=7.1

U: Same as solution G but with diethylene glycol at 3.38 g/l. pH=7.2

V: Same as solution J but without NEODOL 25-7 nonionic surfactant. pH=7.1

W: Same as solution J but without ZONYL FSO nonionic fluorinated surfactant. pH=7.1

Example 1

Processing Methods Using Stabilizing Solutions A, B, C and D

This example compares use of the current FLEXICOLOR® LF Stabilizer and Replenisher (containing hexamethylenetetraamine as dye image stabilizer) with several stabilizing solutions containing m-hydroxybenzaldehyde and various surfactants. Imagewise exposed samples of Films A and B were processed using the protocol described above and the solutions shown in TABLE I below. The results are also shown in TABLE I.

TABLE I

| | Residue Evaluation | | |
|---|---|---|---|
| Stabilizing Solution | Film A | Film B | Observations |
| A | 2 | 3.5 | Overall haze on both |
| (Control) | 2 | 3.5 | films, and drying lines on |
| | 2 | 3 | Film B |
| B | 2.5 | 3 | Residue around |
| (Control) | 2 | 3 | perforations on Film A |
| | 2.5 | 3 | and "chatter" lines on Film B |
| C | 3.5 | 3.5 | Spots on both Film A & B |
| (Control) | 3.5 | 3.5 | |
| | 3.5 | 3.5 | |
| D | 2 | 3 | Thin drying line on Film |
| (Invention) | 2 | 3 | B |
| | 2 | 3.5 | |

The results obtained using Solutions A and D were similar in terms of residue observed on Film A so Solution D is a suitable replacement for Solution A. Solution B (commercial solution) provided slightly worse results with Film A and slightly better results with Film B. In general, all of the solutions produced high residue numbers with Film B. Solution C produced severe spotting on both test films.

Example 2

Processing Methods Comparing Stabilizing Solutions A (Control) with Solutions C and E This example was carried out similarly to Example 1 but the stabilizing solutions contained different biocides. TABLE II below shows the results. Solution E provided an improvement over both Solutions A and C for both films.

TABLE II

| | Residue Evaluation | | |
|---|---|---|---|
| Stabilizing Solution | Film A | Film B | Observations |
| A | 2.5 | 3.5 | Overall scum on both |
| (Control) | 2.5 | 3.5 | films |
| | 2 | 3.5 | |
| C | 3 | 3 | Spots on both films |
| (Control) | 3 | 3 | |
| | 3 | 3 | |
| E | 2 | 2.5 | Thin drying line on |
| (Invention) | 2 | 2.5 | Film B |
| | 2 | 2.5 | |

Example 3

Processing Methods Showing Effect of Adding Propylene Glycol or Diethylene Glycol to Solution E This example was carried out similarly to Example 1 but stabilizer solutions also contained either of two glycols. TABLE III below shows the results. Solutions F and G both provided a dramatic reduction in residue (scum) over solutions A, C and E. Thus, the use of a glycol in the stabilizing solution provides an improvement over solutions of the invention having no glycol.

TABLE III

| | Residue Evaluation | | |
|---|---|---|---|
| Stabilizer Solution | Film A | Film B | Observations |
| A | 3 | 3.5 | Overall scum on both films |
| (Control) | 2.5 | 3.5 | |
| | 3 | 3.5 | |
| C | 3 | 3 | Spots on both films |
| (Control) | 3 | 3 | |
| | 3 | 3 | |
| E | 1.5 | 2.5 | Thin dark line on Film A, and |
| (Invention) | 1.5 | 2.5 | thin dotted line on Film B |
| | 1.5 | 2.5 | |
| F | 1 | 1 | No residue observed |
| (Invention) | 1 | 1 | |
| | 1 | 1 | |
| G | 1 | 1 | No residue observed |
| (Invention) | 1 | 1 | |
| | 1.5 | 1 | |

Example 4

Processing Methods Using Solutions Containing Poly(vinyl pyrrolidone)

This example demonstrates the effect of adding poly(vinyl pyrrolidone) (PVP K-15 from GAF) to the stabilizing solution. This material is included in some conventional stabilizing solutions to control the precipitation of silver sulfide as the solution seasons during use in a minilab processor. Processing was carried out as described in Example 1 above, and the results are shown in TABLE IV below. It is apparent that the addition of PVP to Solution I negatively affected its performance with Film A. However, the addition of PVP to Solution J has only a minimal effect on the performance with both films. A skilled worker in the art would be able to determine the optimal performance possible with a given combination of glycol and PVP.

TABLE IV

| Stabilizer Solution | Residue Evaluation Film A | Film B | Observations |
|---|---|---|---|
| A | 3 | 3.5 | Overall Scum on both films |
| (Control) | 2.5 | 3.5 | |
| | 2.5 | 3.5 | |
| B | 2 | 3 | Residue around perforations |
| (Control) | 2 | 3 | on Film A and "chatter" lines |
| | 1.5 | 3 | on Film B |
| H | 2 | 2 | Thin dotted lines on Film A |
| (Invention) | 2 | 2.5 | and B |
| | 2 | 2 | |
| I | 1 | 1 | No residue observed |
| (Invention) | 1 | 1 | |
| | 1 | 1 | |
| J | 1 | 1 | No residue observed |
| (Invention) | 1 | 1 | |
| | 1 | 1 | |
| K | 2 | 1 | Hazy residue (Film A only) |
| (Invention) | 2 | 1 | |
| | 2 | 1 | |
| L | 1.5 | 1 | Slight hazy residue (1.5 |
| (Invention) | 1 | 1.5 | ratings only) |
| | 1 | 1 | |

Comparative Example 1

Processing Method Using a Glycol in a Commercial Stabilizing Solution

Film sample were processed as described in Example 1, and the results are shown below in TABLE V. The results indicate that the addition of diethylene glycol to Solution C or M resulted in no reduction in spots. Many of these spots tended to be sticky.

TABLE V

| Stabilizer Solution | Residue Evaluation Film A | Film B | Observations |
|---|---|---|---|
| C | 3 | 3.5 | Severe spots on both Film A |
| (Control) | 3 | 4 | and B |
| | 3 | 4 | |
| M | 3.5 | 3.5 | Sticky globs on both Film A |
| (Control) | 3.5 | 3.5 | and B in addition to severe |
| | 3.5 | 3.5 | spots |

Example 5

Use of Different Surfactants in Solution I

In this experiment, the surfactants utilized in the FLEXICOLOR® LF Stabilizer and Replenisher (Solution A), namely WITCOLATE ES-3 anionic surfactant and TRITON X-102 nonionic surfactant were substituted for ZONYL FSO nonionic surfactant and NEODOL 25-7 nonionic surfactant in stabilizing Solution I. The results in TABLE VI below indicate that this substitution resulted in poorer physical performance.

TABLE VI

| Stabilizer Solution | Residue Evaluation Film A | Film B | Observations |
|---|---|---|---|
| H | 1 | 1 | No residue observed |
| (Invention) | 1 | 1 | |
| | 1 | 1 | |
| N | 3 | 2.5 | Thin dotted line on Film A |
| (Control) | 2.5 | 2.5 | and thin line on Film B |
| | 3 | 2.5 | |

Example 6

Use of Various Stabilizing Solutions in a Minilab Processor

A stabilizing solution having the following formulation was added to a prototype fast access color negative film processor having two (2) counter-current replenished stabilizer tanks and a total "wet stabilizer" access time of about 30 seconds including crossover time. The stabilizer tanks were of the low-volume-thin-tank processor design (described for example in U.S. Pat. No. 5,436,118 of Carli et al), and the solutions were fully "seasoned" by processing sufficient film to result in at least three turnovers of tank volume due to replenishment at the rate of 36 ml/linear meter of perforated 135 mm film.

| Component | Amount |
|---|---|
| Water | 700.0 ml |
| Propylene Glycol | 13.5 g |
| m-Hydroxybenzaldehyde | 1.50 g |
| KATHON ® LX biocide (14% solution) | 0.214 g |
| copper nitrate (41% solution) | 0.007 g |
| ZONYL ® FSO nonionic surfactant (50% solution) | 0.050 g |
| NEODOL ® 25–7 nonionic surfactant | 0.20 g |
| pH adjusted to: | |
| (Sulfuric acid or Sodium hydroxide) | 7.5 |
| Water to volume | 1 liter |

Samples of photographic color negative films with a known propensity for base-side scum formation were processed through the automatic fast access processor using the conventional protocol and conditions: i.e., following the prescribed development, bleaching and fixing, the films were passed through the two stabilizer tanks, through squeegee rollers, and a conventional minilab film dryer.

Other samples of the films were passed through a conventional PROCESS C-41RA automatic minilab processor (Noritsu QSF45 L-3U) to provide a Control. In this machine the final stabilizer section consisted of three counter-current sections having a total "wet stabilizer" access time of about 60 seconds including crossover time. The stabilizing solution used in this machine was KODAK FLEXICOLOR® Stabilizer and Replenisher LF, which was fully seasoned by the processing of sufficient film to result in at least three turnovers of tank volume due to replenishment.

The "scum ratings" from the processing of the films are described in Table VII below.

TABLE VII

| SCUM RATING | |
|---|---|
| PROCESS C41RA in Automatic Minilab Processor Using Conventional Solution (CONTROL) | FAST ACCESS PROCESSOR Containing Improved Solution (INVENTION) |
| Noticeable residue, easily observed with a specular light source, but not observed under room lighting (Rating 2–2.5 by scale used in Examples 1–4). | No observable residue when viewed with a specular light source (Rating 1 by scale used in Examples 1–4). |

Samples of two films containing a 236 MD type magenta dye forming color coupler, a deterrent to post-processing image stability if not neutralized, were analyzed by ion chromatography after processing in the same two processors. The results are shown in TABLE VIII below.

TABLE VIII

| 236MD Ion Chromatography Analysis: ($mg/m^2$) | | | | |
|---|---|---|---|---|
| | Control PROCESS C41RA Machine using Conventional Solution (CONTROL) | | Fast Access Processor Containing Improved Solution (INVENTION) | |
| Processor Time after processing | KODAK VERICOLOR ® III | Konica VX-400 | KODAK VERICOLOR ® III | Konica VX-400 |
| 24 hours | 373 | 58 | 124 | 2.2 |
| 30 days | 256 | ND | 70 | ND |

"ND" means "not detectable".

Example 7

Comparing KODAK FLEXICOLOR® Stabilizer and Replenisher LF with Stabilizing Solution of this Invention not containing Glycol—Fresh (unseasoned) Solutions A fast access automatic film processing machine was designed consisting of three (3) counter-current replenished stabilizer tanks with a total "wet stabilizer" access time capable of variation between 43 and 63 seconds including crossover time. The stabilizer tanks were of the low-volume-thin-tank (LVTT) design. (U.S. Pat. No. 5,436,118, noted above). A stabilizing solution of the following formulation was added to the processor:

| Component | Amount |
|---|---|
| Water | 700.0 ml |
| m-Hydroxybenzaldehyde | 1.50 g |
| KATHON ® LX biocide (14% solution) | 0.143 g |
| Copper nitrate (41% solution) | 0.005 g |
| ZONYL ® FSO nonionic surfactant (50% solution) | 0.050 g |
| NEODOL ® 25–7 non-ionic surfactant | 0.20 g |
| pH adjusted to with Sulfuric acid or Sodium hydroxide | 7.5 |
| Water to volume | 1 liter |

Films with a known propensity for base-side scum formation were processed through the automatic fast access processor. Following the prescribed development, bleaching and fixing baths, the films passed through the three stabilizer tanks, squeegee rollers, and a conventional minilab film dryer.

The stabilizer tanks were drained, rinsed, and charged with KODAK FLEXICOLOR® Stabilizer and Replenisher LF. Samples of the same films were processed through the automatic fast access processor, again with varying stabilization times between 43 and 63 seconds.

The base-side scum propensity of the films processed through the two stabilizing solutions was compared. It was noted that within the time range studied (i.e., 43 to 63 seconds), scum severity was insensitive to stabilizing solution residency time. The results are shown in TABLE IX below.

TABLE IX

| Scum Rating | |
|---|---|
| KODAK FLEXICOLOR ® Stabilizer and Replenisher LF (CONTROL) | Example 7 (INVENTION) |
| Residue easily seen under room lighting (Rating 3 by scale used in Examples 1–4). | Residue seen under specular light, but not under normal room lighting (Rating 2 by scale used in Examples 1–4). |

Example 8

Formulation of a Concentrated Stabilizing Solution

Two concentrated stabilizing solutions of this invention were prepared as follows. The working strength stabilizing solutions described in the previous examples are commonly sold in a concentrated form (18 ml/l dilution).

Concentrates of the most preferred Solutions I and J were prepared. In order to determine the robustness of each solution, rudimentary high temperature and low temperature keeping tests were performed.

Test Procedure:

20 ml of concentrate were placed in 25 ml glass scintillation vials and stored at room temperature, 110° F. (43° C.) and 30° F. (−1° C.). After 2 days, the vials are removed from the high and low temperature incubators and allowed to come (undisturbed) to room temperature. The incubated samples were then compared to a room temperature sample and the differences were noted.

The concentrate solutions were comprised of the following components:

| | |
|---|---|
| m-hydroxybenzaldehyde | 83.33 g/l |
| KATHON ® LX biocide | 1.11 g/l |
| Copper nitrate | 0.11 g/l |
| ZONYL ® FSO nonionic surfactant | 1.39 g/l |
| NEODOL ® 25–7 nonionic surfactant | 11.11 g/l |
| Propylene glycol or diethylene glycol | 750.0 g/l |
| unadjusted pH (propylene glycol) = working strength pH of 7.2 | 5.30 for a |
| unadjusted pH (diethylene glycol) = working strength pH of 7.1 | 5.37 for a |

The solution samples kept at the high and low temperatures (with either propylene glycol or diethylene glycol) showed little or no difference in performance, when compared to the room temperature sample.

These concentrates were diluted 56 times with water to provide working strength solutions for use in photographic processing.

Example 9

Evaluation of Stabilizing Solutions G and O

In this example, the stabilizing solutions contained an anionic nonfluorinated sulfate as the first surfactant, in admixture with a nonionic fluorinated surfactant as the second surfactant. Films A and B were processed and evaluated as described in Examples 1–5 above. TABLE X below shows the results.

TABLE X

| Stabilizer Solution | Residue Evaluation Film A | Film B | Observations |
|---|---|---|---|
| G | 1 | 1 | |
| | 1.5 | 1 | |
| | 1 | 1 | |
| O | 2.5 | 1 | Drying lines observed on Film A |
| | 2.5 | 1 | |
| | 2 | 1 | |

Example 10

Evaluation of Stabilizing Solution Q

In this example stabilizing solution contained an anionic fluorinated surfactant as the first surfactant, in admixture with a nonionic fluorinated surfactant as the second surfactant. Films A and B were processed and evaluated as described in Examples 1–5 above. TABLE XI below shows the results

TABLE XI

| Stabilizer Solution | Residue Evaluation Film A | Film B | Observations |
|---|---|---|---|
| Q | 1 | 1 | Slight hazy (ill-defined) drying lines seen on Film A |
| | 1.5 | 1 | |
| | 1 | 1 | |

Example 11

Evaluation of Stabilizing Solutions P–0U

Several stabilizing solutions were tested having varying amounts and types of glycols, or a different stabilizing compound. They were used to process Film A and B, and evaluated, as described in Examples 1–5 above. The results are shown in TABLE XII below.

TABLE XII

| Stabilizer Solution | Residue Evaluation Film A | Film B | Observations |
|---|---|---|---|
| P | 1 | 1 | |
| | 1 | 1 | |
| | 1 | 1 | |
| R | 1 | 1 | |
| | 1.5 | 1 | |
| | 1 | 1 | |

TABLE XII-continued

| Stabilizer Solution | Residue Evaluation Film A | Film B | Observations |
|---|---|---|---|
| S | 2.5 | 2.5 | Dark tacky drying |
| | 3 | 2.5 | lines observed on |
| | 2.5 | 3 | both films |
| T | 1 | 1 | |
| | 1 | 1 | |
| | 1 | 1 | |
| U | 1.5 | 1 | |
| | 1 | 1 | |
| | 1 | 1 | |

Example 12

Evaluation of Stabilizing Solutions J, V and W

This example compares the use of stabilizing solution J to similar solutions that have only one of the requisite surfactants. Fully exposed (fogged) samples of Films A and B were processed using the protocol described above, and evaluated as described in Example 1. The results are shown in Table XIII below.

TABLE XIII

| Stabilizer Solution | Residue Evaluation Film A | Film B | Observations |
|---|---|---|---|
| J | 1.5 | 1 | Thin drying lines |
| | 1.5 | 1 | near Film A edges |
| | 1 | 1 | |
| V | 3 | 3 | Severe spots on both |
| | 3 | 3 | films |
| | 3 | 3 | |
| W | 2 | 1.5 | Hazy (ill-defined) |
| | 2 | 1.5 | drying lines |
| | 1.5 | 2 | observed on edges of both films |

The test results from processing both films indicate that there is a definite reduction in base-side processing defects (drying lines, scum, spots) when the stabilizing solution of this invention, that is having a combination of surfactants, is used, compared to use of solutions with only a single surfactant.

The invention has been described in detail with particular reference to preferred embodiments thereof, but it will be understood that variations and modifications can be effected within the spirit and scope of the invention.

We claim:

1. A photographic dye image stabilizing solution comprising:

a) a compound represented by structure I present at a concentration of at least 0.5 g/l, b) a first surfactant that is:

a nonionic polyethoxylated, non-fluorinated surfactant, or an anionic non-fluorinated sulfate or sulfonate surfactant, said first surfactant being present at a concentration of at least 0.03 g/l, and c) a second surfactant that is a nonionic or anionic fluorinated surfactant present at a concentration of at least 0.005 g/l, said structure I being

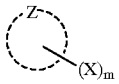

wherein Z represents the carbon, nitrogen, sulfur or oxygen atoms necessary to form a 5- to 10-membered carbocyclic or heterocyclic ring, X is an aldehyde group or $(R_1O)(R_2O)CH$— group, $R_1$ and $R_2$ are independently hydrogen or an alkyl group of 1 to 6 carbon atoms, provided that at least one of $R_1$ and $R_2$ is said alkyl group, and m is 1 to4, and d) a water-soluble or water-dispersible glycol at a concentration of from about 0.5 to about 20 g/l.

2. The solution of claim 1 wherein Z represents the atoms necessary to complete a phenyl, thiophene, pyrrole, furan, thiazole, imidazole, pyrazole, succinimide, triazole, tetrazole, pyridine, pyrimidine, triazine or thiadiazine ring, $R_1$ and $R_2$ are independently hydrogen, methyl or ethyl provided at least one of them is methyl or ethyl, and m is 1 or 2.

3. The solution of claim 2 wherein Z represents the atoms necessary to complete a phenyl ring, $R_1$ is hydrogen, and $R_2$ is methyl.

4. The solution of claim 1 wherein said compound of structure

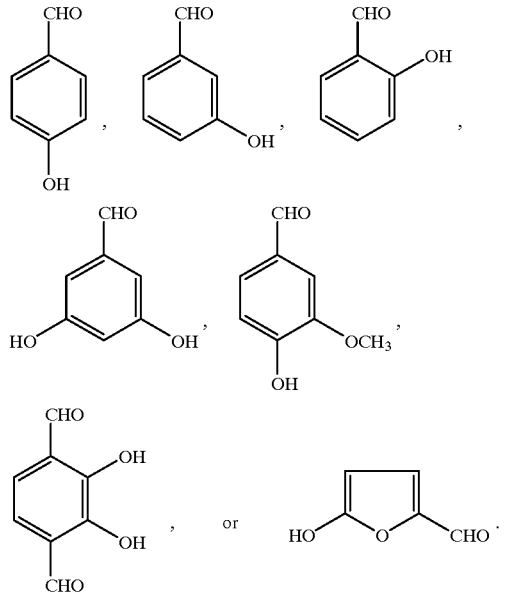

5. The solution of claim 1 wherein said compound of structure I is m- or p-hydroxybenzaldehyde, or a mixture thereof.

6. The solution of claim 1 wherein said compound of structure I is present in at a concentration of from about 0.5 to about 5 g/l.

7. The solution of claim 1 wherein said first surfactant is a nonionic polyethoxylated, non-fluorinated surfactant that has the general formula (I):

$$R—(B)_x—(E)_n—D$$

wherein R is alkyl having 8 to 20 carbon atoms, B is phenylene, x if 0 or 1, E is $—(OCH_2CH_2)—$, n is an integer of 6 to 20, and D is hydroxy or methoxy.

8. The solution of claim 7 wherein said polyethoxylated non-fluorinated surfactant is octylphenoxypoly (ethyleneoxide)(9) ethanol, octylphenoxypoly (ethyleneoxide)(12) ethanol, octylphenoxypoly (ethyleneoxide)(30–40) ethanol, alkyl($C_{12-15}$ mixture) poly (ethyleneoxide)(7) alcohol, tridecylpolyethyleneoxide(12), poly(ethylene oxide)-poly(propylene oxide), poly(ethylene oxide) di-ol, or nonylphenoxy poly[hydroxy propylene oxide(8–10)].

9. The solution of claim 1 wherein said first surfactant is an anionic non-fluorinated sulfate or sulfonate surfactant represented by the formula:

$$R_3—(A)—C$$

or $$(R_4)_p—(B)_y—(E)_z—C$$

wherein $R_3$ is an alkyl group of 8 to 20 carbon atoms, A is an arylene or hydroxyethylene group, C is $—SO_3^-M^+$ or $—SO_4^-M^+$ wherein $M^+$ is hydrogen, or ammonium or an alkali metal ion, $R_4$ is an alkyl group of 4 to 20 carbon atoms, y is 0 or 1, p is 1 when y is 0, and p is 1, 2 or 3 when y is 1, B is a phenylene group, E is $—(OCH_2CH_2)—$, and z is an integer from 1 to 8.

10. The solution of claim 9 wherein said second surfactant is an alkylbenzenesulfonate, a 2-hydroxytetra, alkane-1-sulfonate, an alkylphenoxypolyethoxysulfate, or an alkylpolyethoxysulfate.

11. The solution of claim 1 wherein said second surfactant is a sodium perfluorooctane sulfonate.

12. The solution of claim 1 wherein said nonionic fluorinated surfactant has the formula:

$$R_f—CH_2CH_2O—(CH_2CH_2O)_z—H$$

wherein $R_f$ is $$F—(CF_2CF_2)_{3-8}—$$

and z is 4 to 20.

13. The solution of claim 1 wherein the concentration of said first surfactant is from about 0.03 to about 5 g/l, and the concentration of said second surfactant is from about 0.005 to about 3 g/l, and the weight ratio of said first surfactant to said second surfactant is from about 1:1000 to about 1000:1.

14. The solution of claim 13 wherein the concentration of said first surfactant is from about 0.05 to about 0.5 g/l, the concentration of said surfactant is from about 0.01 to about 0.1 g/l, and the weight ratio of said first surfactant to said second surfactant is from about 1:30 to about 30:1.

15. The solution of claim 1 further comprising a water-soluble or water-dispersible glycol at a concentration of from about 0.5 to about 20 g/l.

16. The solution of claim 1 wherein said glycol is propylene glycol, diethylene glycol, triethylene glycol, tetraethylene glycol, ethylene glycol, or a mixture of any of these.

17. The solution of claim 16 wherein said glycol is present at a concentration of from about 3 to about 15 g/l.

18. A concentrated photographic dye image stabilizing solution comprising:

a) a compound represented by structure I present at a concentration of from about 15 to about 300 g/l, b) a first surfactant that is:

a nonionic polyethoxylated, non-fluorinated surfactant, or an anionic non-fluorinated sulfate or sulfonate surfactant, said first surfactant being present at a concentration of from about 0.9 to about 600 g/l, c) a second surfactant that is a nonionic or anionic fluorinated surfactant present at a concentration of from about 0.15 to about 300 g/l, and d) a water-soluble or water-dispersible glycol at a concentration of from about 15 to about 1000 g/l, said structure I being

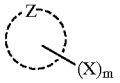

wherein Z represents the carbon, nitrogen, sulfur or oxygen atoms necessary to form a 5- to 10-membered carbocyclic or heterocyclic ring, X is an aldehyde group or $(R_1O)(R_2)CH—$ group, $R_1$ and $R_2$ are independently hydrogen or an alkyl group of 1 to 6 carbon atoms, provided that at least one of $R_1$ and $R_2$ is said alkyl group, and m is 1 to 4.

19. The concentrate of claim 18 wherein:

said compound represented by structure I is present at a concentration of from about 30 to about 360 g/l, said first surfactant is present at a concentration of from about 1.5 to about 60 g/l, said second surfactant is present at a concentration of from about 0.3 to about 12 g/l, and said glycol is present at a concentration of from about 90 to about 1000 g/l.

20. The concentrate of claim 18 wherein:

said compound represented by structure I is present at a concentration of from about 50 to about 210 g/l, said first surfactant is present at a concentration of from about 5 to about 35 g/l, said second surfactant is present at a concentration of from about 0.5 to about 7 g/l, and said glycol is present at a concentration of from about 150 to about 900 g/l.

* * * * *